US007203330B2

(12) United States Patent
Chang

(10) Patent No.: US 7,203,330 B2
(45) Date of Patent: Apr. 10, 2007

(54) SWITCHING UNIT FOR A MICROPHONE

(75) Inventor: Chao-Chih Chang, Taichung (TW)

(73) Assignee: Taiwan Carol Electronics Co. Ltd., Taichung (TW)

( * ) Notice: Subject to any disclaimer, the term of this patent is extended or adjusted under 35 U.S.C. 154(b) by 447 days.

(21) Appl. No.: 10/900,559

(22) Filed: Jul. 28, 2004

(65) Prior Publication Data

US 2005/0058308 A1 Mar. 17, 2005

(30) Foreign Application Priority Data

Sep. 15, 2003 (TW) ..... 92125373 A

(51) Int. Cl.
*H04R 25/00* (2006.01)

(52) U.S. Cl. ..... 381/361; 381/355; 338/178; 338/179

(58) Field of Classification Search ..... 381/355, 381/361, 366, 368; 338/176, 178, 179; 200/16 D, 200/430
See application file for complete search history.

(56) References Cited

U.S. PATENT DOCUMENTS 3,604,853 A * 9/1971 Pless ..... 381/91
3,643,046 A * 2/1972 Zdanys et al. ..... 200/430
4,910,795 A * 3/1990 McCowen et al. ..... 455/95
5,315,079 A * 5/1994 Gierut ..... 200/16 D
5,706,359 A * 1/1998 Chang ..... 381/361
6,597,796 B2 * 7/2003 Chang ..... 381/361

* cited by examiner

*Primary Examiner*—Curt Kuntz
*Assistant Examiner*—Tuan Duc Nguyen
(74) *Attorney, Agent, or Firm*—Trop, Pruner & Hu, P.C.

(57) ABSTRACT

A switching unit for a microphone includes a slider-mounting member, a slider mounted slidably on the slider-mounting member and having an operating element, and a slider-positioning mechanism mounted on the slider-mounting member and defining an elongated slot for extension of the operating element therethrough. The slider-positioning mechanism includes a resistance-providing member and two retaining members. The operating element is in sliding contact with the resistance-providing member such that the resistance-providing member provides a resistance to the operating element when the slider is disposed at a non-retaining position. The operating element is retained releasably by one of the retaining members when the slider is moved to a retaining position.

4 Claims, 8 Drawing Sheets

SWITCHING UNIT FOR A MICROPHONE

CROSS-REFERENCE TO RELATED APPLICATION

This application claims priority of Taiwanese patent application No. 092125373, filed on Sep. 15, 2003.

BACKGROUND OF THE INVENTION

1. Field of the Invention

This invention relates to a switching unit for a microphone, more particularly to a switching unit having a resistance-providing member, a slider in sliding contact with the resistance-providing member, and retaining members disposed adjacent to two opposite ends of the resistance-providing member.

2. Description of the Related Art

U.S. Pat. No. 6,597,796 discloses a microphone that includes a housing, a terminal member disposed in the housing and having a plurality of spaced apart terminals, and a variable resistance switch. The switch includes at least an elongated resistance member disposed in the housing, extending in a longitudinal direction, and having opposite first and second ends connected to respective ones of the terminals. An elongated conductive member is disposed in the housing adjacent and parallel to the resistance member, and has one end connected to a respective one of the terminals. A slide member includes at least a resilient conductive wiper that is disposed in the housing and that is simultaneously and constantly in sliding contact with the resistance member and the conductive member so as to complete a circuit through the terminals, the conductive member, and the resistance member. The slide member is operable to move in the longitudinal direction between an ON position, in which, the wiper is in sliding contact with the second end of the resistance member, and an OFF position, in which, the wiper is in sliding contact with the first end of the resistance member. The wiper is slidable over the conductive member and the resistance member so as to vary the resistance in the circuit when the slide member moves between the ON and OFF positions.

The aforesaid switch is disadvantageous in that it lacks a mechanism which is capable of enabling the user to having a feeling whether or not the slide member has reached a selected one of the ON and OFF positions during operation of the switch.

The entire disclosure of U.S. Pat. No. 6,597,796 is incorporated herein by reference.

SUMMARY OF THE INVENTION

Therefore, the object of the present invention is to provide a switching unit for a microphone that is capable of overcoming the aforesaid drawback of the prior art.

According to the present invention, there is provided a switching unit for a microphone. The switching unit comprises: a slider-mounting member; a slider mounted slidably on the slider-mounting member and slidable in a longitudinal direction between first and second retaining positions, the slider including an operating element; and a slider-positioning mechanism mounted on the slider-mounting member and defining an elongated slot for extension of the operating element therethrough. The elongated slot extends in the longitudinal direction and has two opposite ends. The slider-positioning mechanism includes a resistance-providing member that is disposed between the ends of the elongated slot and that has two opposite ends, and two retaining members, each of which is disposed adjacent to a respective one of the ends of the resistance-providing member and each of which is disposed at a position corresponding to a respective one of the first and second retaining positions of the slider. The operating element is in sliding contact with the resistance-providing member such that the resistance-providing member provides a resistance to the operating element when the slider is disposed at a non-retaining position between the first and second retaining positions. The operating element is retained releasably by one of the retaining members when the slider is moved to a respective one of the first and second retaining positions. The operating element ceases to be acted upon by the resistance-providing member such that the operating element is relieved from the resistance provided by the resistance-providing member when the slider is moved to one of the first and second retaining positions, thereby enabling the user to have a feeling that the slider has reached said one of the first and second retaining positions.

BRIEF DESCRIPTION OF THE DRAWINGS

In drawings which illustrate an embodiment of the invention.

DETAILED DESCRIPTION OF THE PREFERRED EMBODIMENT

Figure 7:
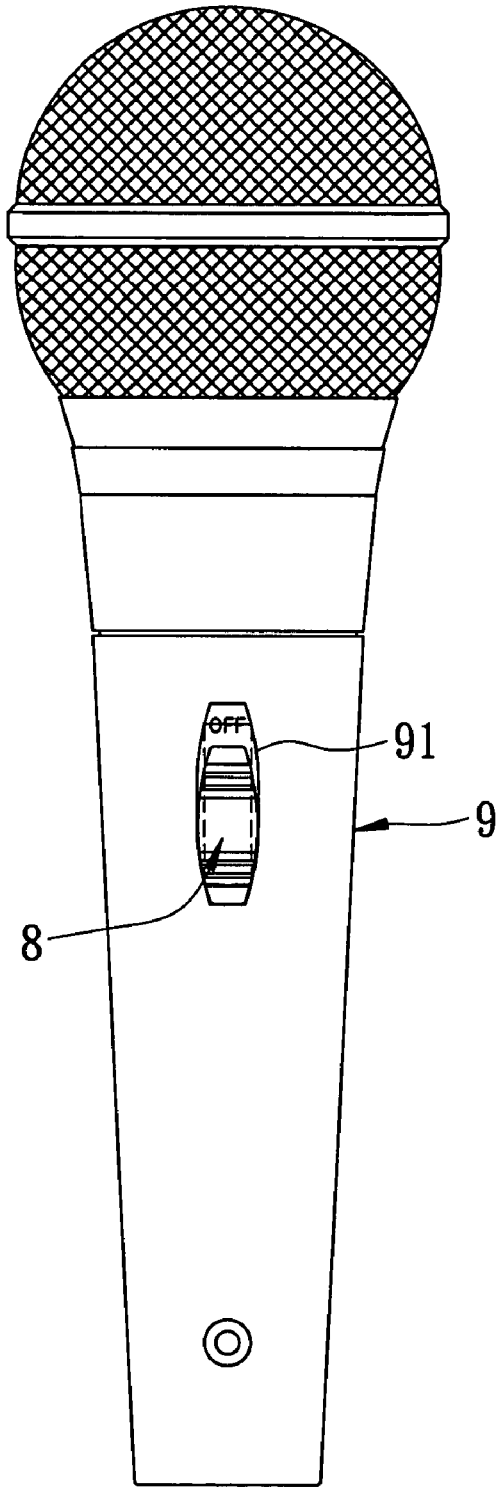
FIG. 7 is a side view to illustrate how the switching unit of the preferred embodiment is mounted on a microphone.
Figure 8:
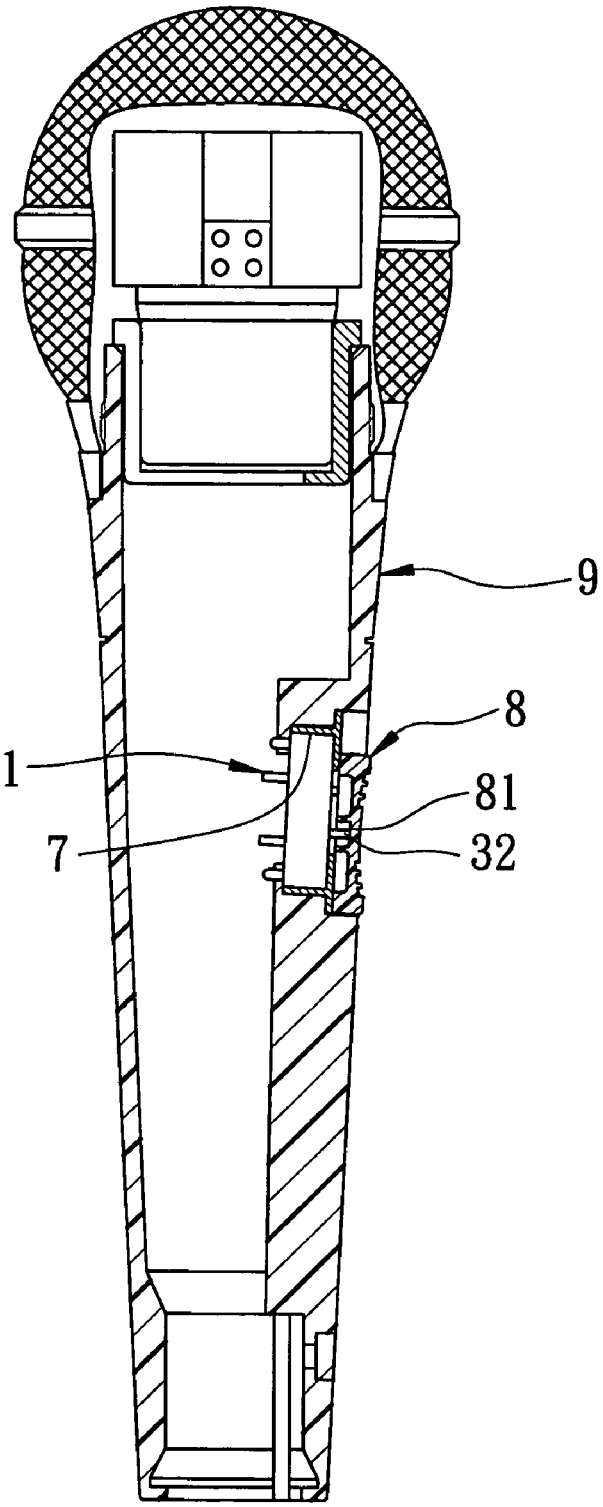
FIG. 8 is a sectional view of the microphone of FIG. 7.

FIGS. 1 to 4 illustrate the preferred embodiment of a switching unit for a microphone 9 (see FIGS. 7 and 8) according to this invention. The switching unit is mounted in a mounting hole 91 in a housing of the microphone 9, and includes a variable resistance switch 1 and a slider-positioning mechanism 7.

Figure 1:
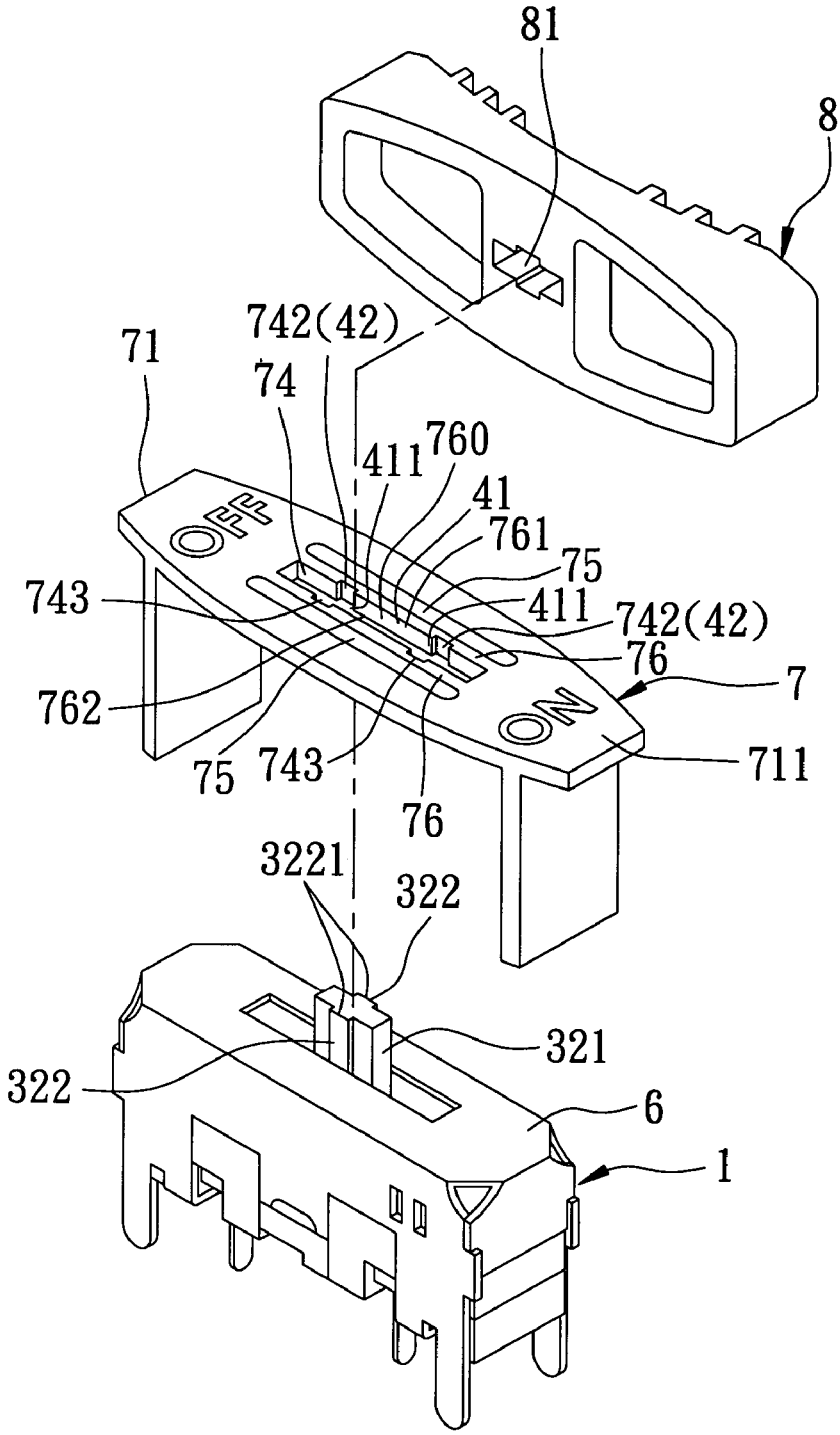
FIG. 1 is an exploded perspective view of the preferred embodiment of a switching unit according to this invention.
Figure 2:
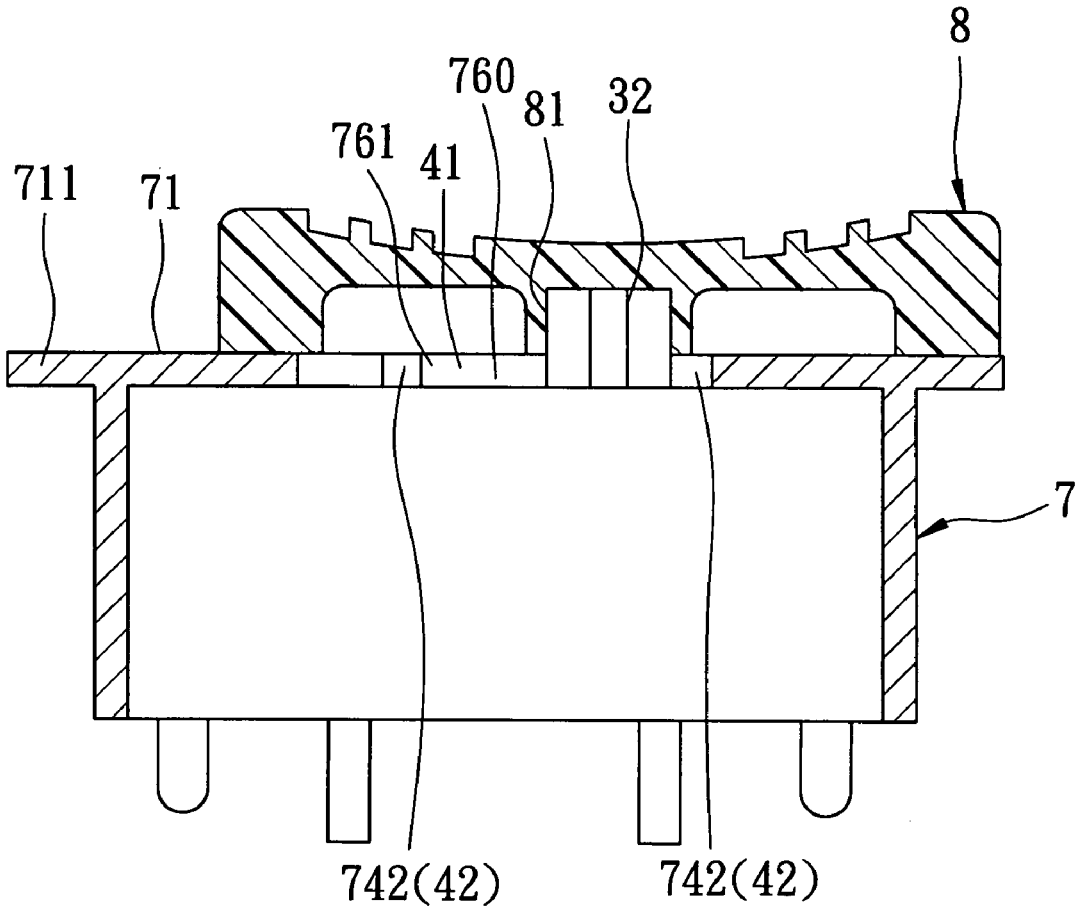
FIG. 2 is a sectional view of the preferred embodiment.
Figure 3:
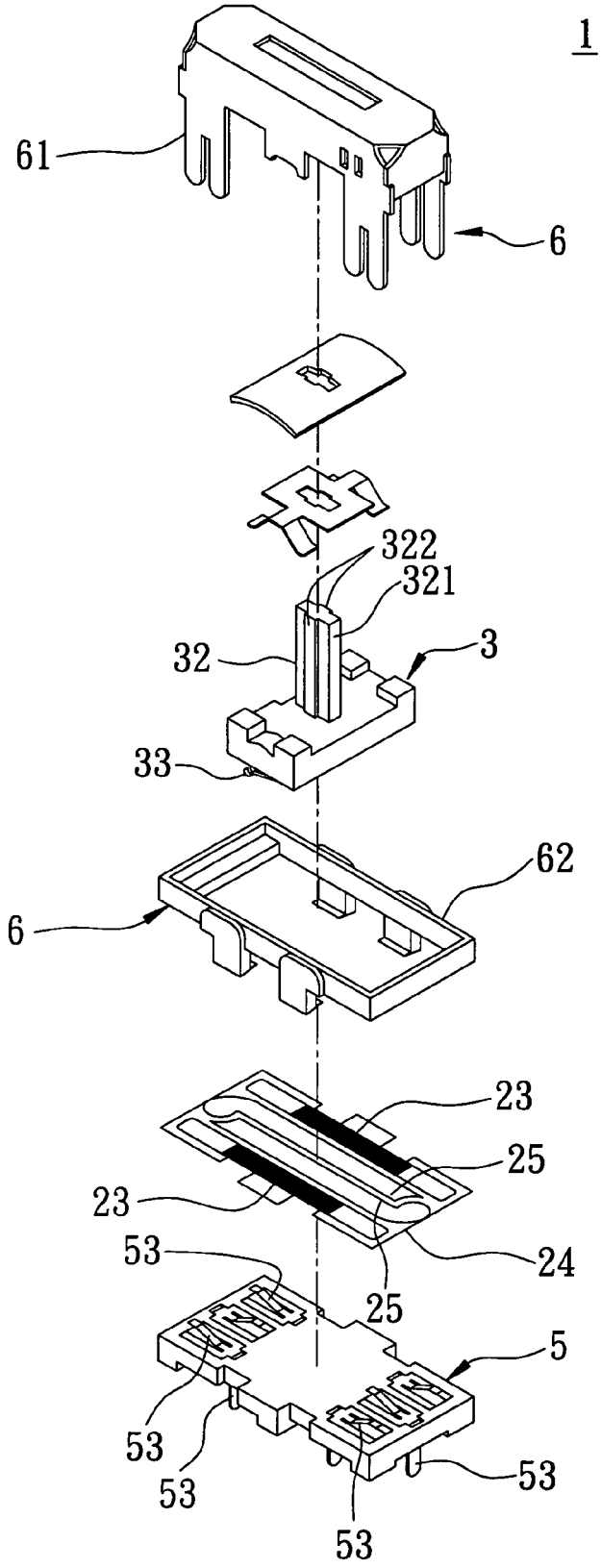
FIG. 3 is an exploded perspective view of a variable resistance switch of the switching unit of the preferred embodiment.
Figure 4:
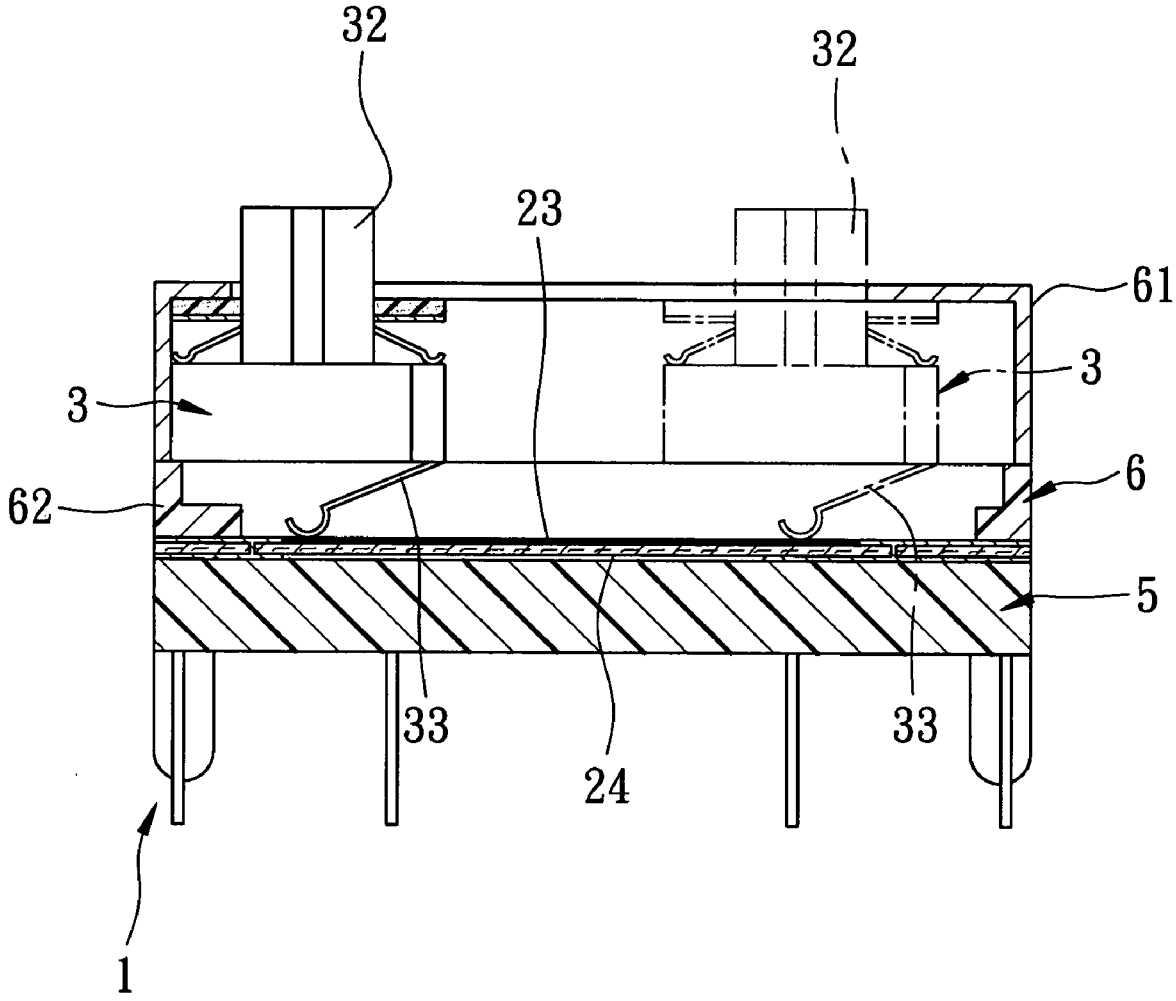
FIG. 4 is a side sectional view of the variable resistance switch of the switching unit.
Figure 5:
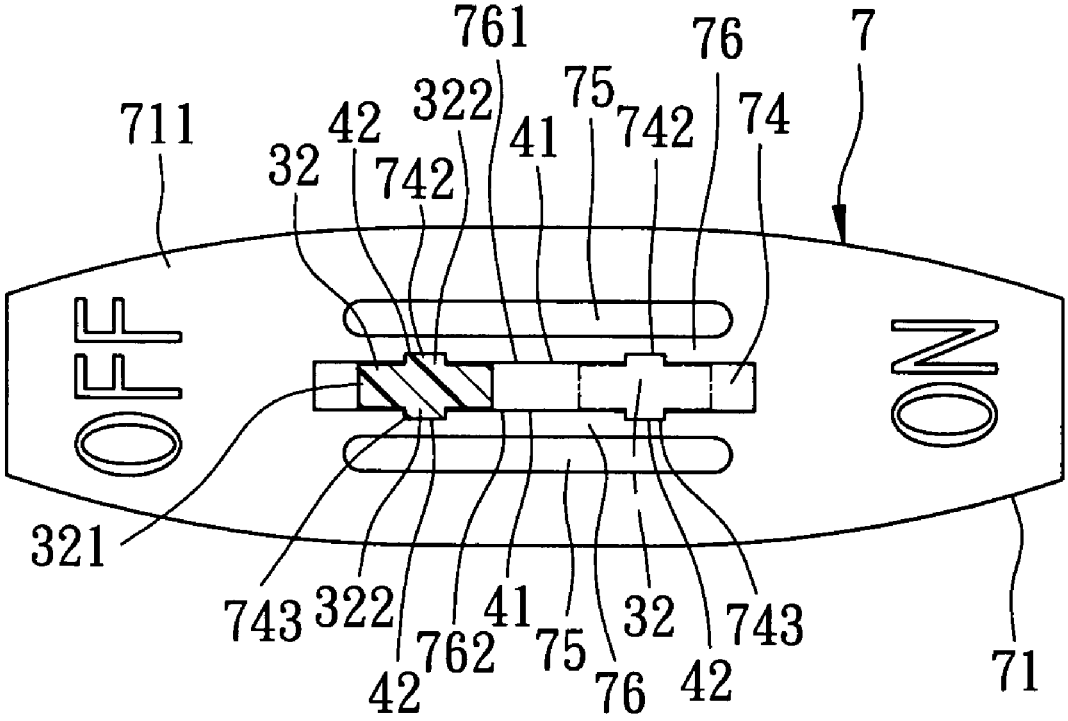
FIG. 5 is a top sectional view illustrating a state where a slider of the switching unit is disposed at a retaining position.

The variable resistance switch 1 includes a terminal-mounting seat 5 with a plurality of terminals 53 mounted thereon, an insulating sheet 24 mounted on the terminal-mounting seat 5 and formed with a pair of elongated resistance members 23 and a pair of conductive members 25 thereon, a slider-mounting member 6 including upper and lower parts 61, 62 that are connected to each other and that are mounted on the insulating sheet 24, a slider 3 mounted slidably on the slider-mounting member 6 and slidable in a longitudinal direction between first and second retaining positions (see FIGS. 4 and 5), and a pair of resilient conductive wipers 33 (only one wiper 33 is shown in FIG. 3) mounted on the slider 3 and in sliding contact with the respective pairs of the resistance members 23 and the conductive members 25 so as to complete circuits through the terminals 53, the conductive members 25, and the resistance members 23. The slider 3 includes an operating element 32 that projects therefrom.

The slider-positioning mechanism 7 is mounted on the slider-mounting member 6, and defines an elongated slot 74 for extension of the operating element 32 therethrough. The elongated slot 74 extends in the longitudinal direction, and has two opposite ends. The slider-positioning mechanism 7 includes a resistance-providing member 4 that is disposed between the ends of the elongated slot 74 and that has two opposite ends 411, and two retaining members 42, each of which is disposed adjacent to a respective one of the ends 411 of the resistance-providing member 41 and each of which is disposed at a position corresponding to a respective one of the first and second retaining positions of the slider 3. The operating element 32 is in sliding contact with the resistance-providing member 41 such that the resistance-providing member 41 provides a resistance to the operating element 32 when the slider 3 is disposed at a non-retaining position (see FIG. 6) between the first and second retaining positions. The operating element 32 is retained releasably by one of the retaining members 42 when the slider 3 is moved to a respective one of the first and second retaining positions (see FIG. 5). The operating element 32 ceases to be acted upon by the resistance-providing member 41 such that the operating element 32 is relieved from the resistance provided by the resistance-providing member 41 when the slider 3 is moved to one of the first and second retaining positions, thereby enabling the user to have a feeling that the slider 3 has reached the one of the first and second retaining positions.

In this embodiment, the slider-positioning mechanism 7 includes a positioning seat 71 that has a top plate 711. The elongated slot 74 is formed in the top plate 711, and has two opposite sides. The top plate 711 is formed with two opposite elongated openings 75 that extend in the longitudinal direction and that are respectively disposed at the sides of the elongated slot 74, and first and second elongated ribs 76, each of which extends in the longitudinal direction, each of which is disposed between a respective one of the openings 75 and the slot 74, and each of which is elastically deformable in a transverse direction relative to the longitudinal direction. The first and second ribs 76 respectively have opposing first and second inner wall surfaces 761, 762 that face the elongated slot 74 and that respectively have first and second middle portions 760 which cooperatively define the resistance-providing member 41.

Figure 6:
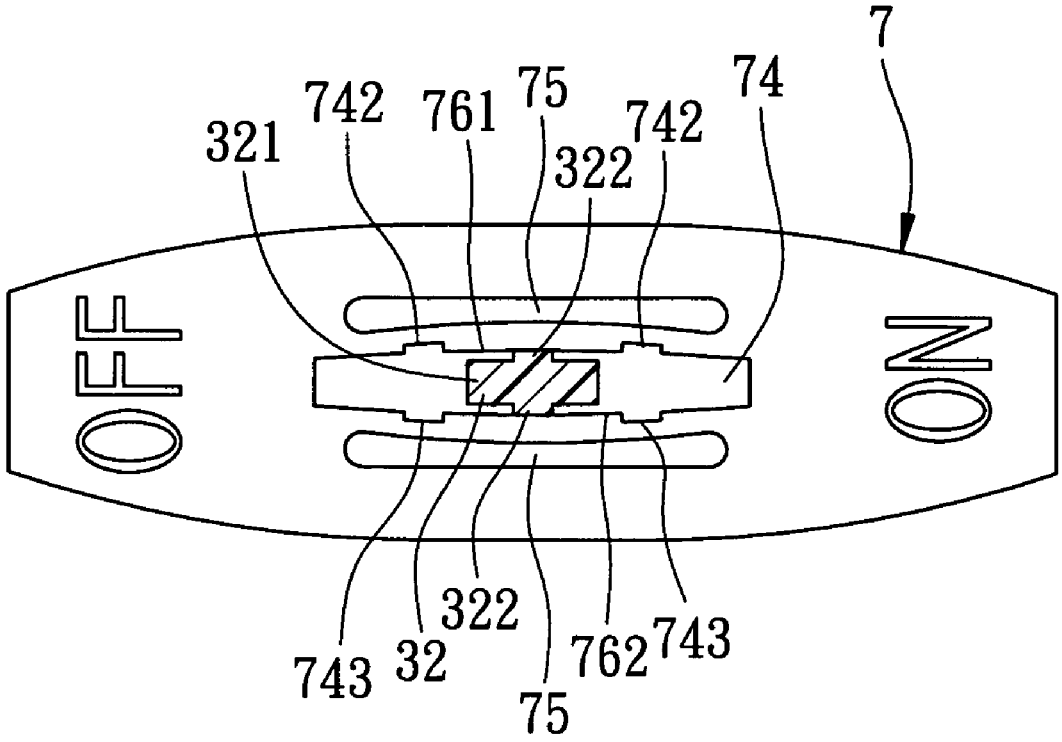
FIG. 6 is a top sectional view illustrating a state where the slider of the switching unit is disposed at a non-retaining position.

The operating element 32 has a main body 321 (see FIG. 1) extending through the elongated slot 74 and having two opposite sides, and opposite first and second protrusions 322 that respectively project from the sides of the main body 321 in the transverse direction and that respectively have first and second free ends 3221 (see FIG. 1) which are respectively in sliding contact with the first and second middle portions 760 of the first and second inner wall surfaces 761, 762 of the first and second ribs 76 and which push the first and second ribs 76 to deform in the transverse direction when the slider 3 is disposed at the non-retaining position (see FIG. 6).

The first inner wall surface 761 of the first rib 76 is formed with two spaced apart first recesses 742. The second inner wall surface 762 of the second rib 76 is formed with two spaced apart second recesses 743 that are respectively aligned with the first recesses 742. Each of the first recesses 742 cooperates with the aligned one of the second recesses 743 to define a respective one of the retaining members 42. The first and second protrusions 322 project respectively into an aligned pair of the first and second recesses 742, 743 (see FIG. 5) when the slider 3 is disposed at one of the first and second retaining positions, thereby retaining the slider 3 at said one of the first and second retaining positions and restoring of the first and second ribs 76 to a non-deformed state.

A grip member 8 is disposed slidably on the top plate 711 of the positioning seat 71, and is formed with a cross hole 81 for engaging the operating element 32 so as to facilitate operation of the operating element 32 of the slider 3.

With the inclusion of the slider-positioning mechanism 7 in the switching unit of this invention, the aforesaid drawback associated with the prior art can be eliminated.

With the invention thus explained, it is apparent that various modifications and variations can be made without departing from the spirit of the present invention. It is therefore intended that the invention be limited only as recited in the appended claims.

I claim:

1. A switching unit for a microphone, comprising:

a slider-mounting member;

a slider mounted slidably on said slider-mounting member and slidable in a longitudinal direction between first and second retaining positions, said slider including an operating element; and a slider-positioning mechanism mounted on said slider-mounting member and defining an elongated slot for extension of said operating element therethrough, said elongated slot extending in said longitudinal direction and having two opposite ends, said slider-positioning mechanism including a resistance-providing member that is disposed between said ends of said elongated slot and that has two opposite ends, and two retaining members, each of which is disposed adjacent to a respective one of said ends of said resistance-providing member and each of which is disposed at a position corresponding to a respective one of said first and second retaining positions of said slider;

wherein said operating element is in sliding contact with said resistance-providing member such that said resistance-providing member provides a resistance to said operating element when said slider is disposed at a non-retaining position between said first and second retaining positions;

wherein said operating element is retained releasably by one of said retaining members when said slider is moved to a respective one of said first and second retaining positions; and wherein said operating element ceases to be acted upon by said resistance-providing member such that said operating element is relieved from the resistance provided by said resistance-providing member when said slider is moved to one of said first and second retaining positions, thereby enabling the user to have a feeling that said slider has reached said one of said first and second retaining positions.

2. The switching unit of claim 1, wherein said slider-positioning mechanism includes a positioning seat that has a top plate, said elongated slot being formed in said top plate and having two opposite sides, said top plate being formed with two opposite elongated openings that extend in said longitudinal direction and that are respectively disposed at said sides of said elongated slot, and first and second elongated ribs, each of which extends in said longitudinal direction, each of which is disposed between a respective one of said openings and said slot, and each of which is elastically deformable in a transverse direction relative to said longitudinal direction, said first and second ribs respectively having opposing first and second inner wall surfaces that face said elongated slot and that respectively have first and second middle portions which cooperatively define said resistance-providing member.

3. The switching unit of claim 2, wherein said operating element has a main body extending through said elongated slot and having two opposite sides, and opposite first and second protrusions that respectively project from said sides of said main body in said transverse direction and that respectively have first and second free ends which are respectively in sliding contact with said first and second middle portions of said first and second inner wall surfaces of said first and second ribs and which push said first and second ribs to deform in said transverse direction when said slider is disposed at said non-retaining position.

4. The switching unit of claim 3, wherein said first inner wall surface of said first rib is formed with two spaced apart first recesses, said second inner wall surface of said second rib being formed with two spaced apart second recesses that are respectively aligned with said first recesses, each of said first recesses cooperating with the aligned one of said second recesses to define a respective one of said retaining members, said first and second protrusions projecting respectively into an aligned pair of said first and second recesses when said slider is disposed at one of said first and second retaining positions, thereby retaining said slider at said one of said first and second retaining positions and restoring said first and second ribs to a non-deformed state.

* * * * *